US007078661B2

(12) United States Patent
Kim et al.

(10) Patent No.: US 7,078,661 B2
(45) Date of Patent: Jul. 18, 2006

(54) APPARATUS FOR SHIELDING ELECTROMAGNETIC WAVE OF MICROWAVE OVEN DOOR

(75) Inventors: Eung Su Kim, Seoul (KR); Jin Yul Hu, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/952,869

(22) Filed: Sep. 30, 2004

(65) Prior Publication Data

US 2005/0072777 A1 Apr. 7, 2005

(30) Foreign Application Priority Data

Oct. 1, 2003 (KR) ..... 10-2003-0068478

(51) Int. Cl.
*H05B 6/76* (2006.01)

(52) U.S. Cl. ..... 219/741; 219/743

(58) Field of Classification Search ..... 219/741, 219/739, 742, 743; 333/12
See application file for complete search history.

(56) References Cited

U.S. PATENT DOCUMENTS 3,794,797 A * 2/1974 Nakano ..... 219/741
3,985,993 A * 10/1976 Imberg et al. ..... 219/741
4,008,383 A * 2/1977 Tanaka et al. ..... 219/740
4,053,731 A * 10/1977 Foerstner ..... 219/742
4,313,044 A * 1/1982 Staats ..... 219/742
4,335,292 A * 6/1982 Tanaka et al. ..... 219/754
4,371,770 A * 2/1983 Gilliatt ..... 219/741
4,390,767 A * 6/1983 Bucksbaum et al. ..... 219/740
4,713,511 A * 12/1987 Katoh ..... 219/740
5,075,525 A * 12/1991 Jung ..... 219/742
5,206,478 A * 4/1993 Lee ..... 219/742
5,958,278 A * 9/1999 Engebritson et al. ..... 219/741
6,812,442 B1 11/2004 Kim et al.
6,927,374 B1 * 8/2005 Hu et al. ..... 219/742

OTHER PUBLICATIONS

U.S. Appl. No. 10/784,291 to Hu et al.
U.S. Appl. No. 10/833,042 to Kim et al.

* cited by examiner

*Primary Examiner*—Daniel I. Robinson
(74) *Attorney, Agent, or Firm*—Greenblum & Bernstein, P.L.C.

(57) ABSTRACT

A microwave oven door, and more particularly, an apparatus for shielding electromagnetic wave that compensates for the length of slots formed in an end of an oven door in order to improve the shielding ability capable of preventing the leakage of electromagnetic wave from the cavity. In the apparatus, a choke structure includes a choke base connected with an inner portion of the oven door, a choke inner side portion bent perpendicularly from the choke base and a choke top bent from the choke inner side portion to contact a front circumferential portion of an oven cavity. Slots are formed in the choke top and the choke inner side portion at a predetermined interval. Each slot is extended from a distal end of the choke top to a predetermined point of the choke inner side portion. The predetermined point is distanced the same as or smaller than the half of the width of the choke inner side portion from a joint between the choke top and the choke inner side portion.

6 Claims, 15 Drawing Sheets

APPARATUS FOR SHIELDING ELECTROMAGNETIC WAVE OF MICROWAVE OVEN DOOR

BACKGROUND OF THE INVENTION

1. Field of the Invention

The present invention relates to a microwave oven door, and more particularly, to an apparatus for shielding electromagnetic wave that compensates for the length of slots formed in an end of an oven door in order to improve the shielding ability capable of preventing the leakage of electromagnetic wave from the cavity.

2. Description of the Related Art

An electric oven generally uses an electric heater as a heat source for generating heat to cook a food loaded into a cooking chamber, and may be auxiliary provided with another heat source. For this purpose, for example, a magnetron is installed in the electrical oven in order to provide electromagnetic wave as the additional heat source.

The operation of a typical electric oven will be described as follows:

In an illustrative electric oven as shown in FIG. 1, a user opens an oven door 3 by pulling a door handle 4 with a hand, loads a food to be cooked into a cavity 2 within an oven housing, closes the oven door 3 to seal the cavity 2, and then operates the electric oven to cook the food.

The user opens/closes the cavity 2 by using the door handle 4 mounted on a top portion of the oven door 3. In this case, a hinge (not shown) connecting a lower end of the housing 1 with a lower end of the door 3 allows the door 3 to be pivoted forward/backward so that the cavity 2 is opened/closed.

Heat generated from a lower heater 7, which is mounted between the bottom of the cavity 2 and the housing 1, is transmitted to the bottom of the cavity 2. Then, the heat is transmitted to the food to be cooked through the air within the cavity 2 and a tray loaded with the food.

Further, heat generated from an upper heater 9, which is mounted above the cavity 2, is transmitted to the food through transmission and convection, and a convection fan 13 is actuated to transmit heat generated from a convection heater 11 to the food in the form of hot wind through a number of through holes 13*a* perforated in the rear side of the cavity 2. In this way, the food loaded on the tray is cooked.

Electromagnetic wave oscillated from a magnetron 15, which is installed in an upper portion of the cavity 2, is directed into the cavity 2 through a waveguide 16 placed above the cavity 2 to function as a heat source of the food to be cooked. The magnetron 15 can be optionally used by the user to cook the food. A cooling fan 17 serves to cool electric components including the magnetron 15, and an oven lamp 18 is configured to illuminate inside a cooking chamber defined by the cavity 2.

Since the typical electric oven cooks the food by using electromagnetic wave generated from the magnetron as described above, it is necessary for the electric oven to prevent the leak of radio frequency radiation. When the door is closed, the electric oven has a uniform gap between the cavity and the door, which forms a slot waveguide allowing the leakage of electromagnetic wave energy generated from the magnetron. In order to prevent the leakage of electromagnetic wave energy, the electric oven is provided with an electromagnetic wave absorbent or a filter around the door or a cavity opening. The filter is generally provided with a choke of a ¼ wavelength dispersion parameter around the door, in which the choke is coupled with the cavity opening.

An apparatus for heating dielectrics by using radio frequency (such as an microwave oven, electric oven, OTR and the like) as described above is configured to trap electromagnetic wave with a cavity 110 and a door 111 as shown in FIG. 2. A filter is installed in a contact region between the cavity 110 and the door 111 in order to prevent the leakage of electromagnetic wave to the outside.

The contact region may have various structures as shown in FIGS. 3 and 4 according to oven types. FIG. 3 illustrates a contact region between a cavity and a door in an electric oven, and FIG. 4 illustrates a contact region between a cavity and a door in a microwave oven.

FIG. 3 illustrates an L-shaped inner end 122 of an oven door 121 coupled with a front portion of a cavity 120 and a choke structure 162 applied to the inner end 122. FIG. 4 illustrates an inner end 132 of an oven door 131 coupled with a front plate 134 of a cavity 130 and a choke structure 142 applied to the inner end 132. In the above types of contact regions, the choke structures 162 and 142 for interrupting the outer leakage of electromagnetic wave are provided in the inner ends 122 and 132 of the oven doors 121 and 131 and the cavities 120 and 130, respectively.

In the meantime, filters as shown in FIGS. 5 and 6 may be selectively applied according to types of the oven shown in FIG. 4.

Referring to FIG. 5, a U-shaped choke structure 142 is formed in an inner end of a door (or door frame) 131. The choke structure 142 is bent into three sections including a choke base 143, a choke inner side portion 144 and a choke top 145. A plurality of L-shaped slots 146 are formed in the choke top 145 and the choke inner side portion 144 at a predetermined interval.

Each of the slots 146 is extended along a first length L1 corresponding to the entire width of the choke top 145 and a second length L2 corresponding to a greater portion of the entire width of the choke inner side portion 144. The slots 146 have a uniform width W, and the choke top 145 is opposed to the cavity.

This choke structure 142 functions to shield the leakage of electromagnetic wave from the cavity.

Referring to FIG. 6, a choke structure 152 is formed in an inner end of a door 131. The choke structure 152 is bent into U-shaped three sections including a choke base 153, a choke inner side portion 154 and choke top 155. A plurality of L-shaped slots 146 are formed in the choke inner side portion 154 and the choke top 155 at a predetermined interval.

Each of the slots 156 is extended along a first length L11 corresponding to the entire width of the choke top 155 and a second length L12 corresponding to a greater portion of the entire width of the choke inner side portion 154. The each slot 156 has a first width W11 in the choke top 155 and a second width W12 in the choke inner side portion 154, in which the second width W12 is larger than the first width W11.

FIG. 7 is a graph illustrating shielding properties of the filters shown in FIGS. 5 and 6, in which though incidence angles have a diverse range of from 0° to 90°, only three different incidence angles are exemplified for the convenience of description.

As shown in FIG. 7, when radio frequencies of different incidence angles I1, I2 and I3 are introduced into the choke structures as shown in FIGS. 5 and 6, respectively, the choke structure shows a shielding property that the optimum shielding frequency is lowered from fo to fo' as the incidence angle increases. That is, it is known that when the incidence angle I3 is 16.7°, the optimum shielding frequency is fo, and when the incidence angle I1 is 39.9°, the optimum shielding frequency is fo'. The shielding ability is limited to a specific single frequency. This feature represents that the optimum shielding frequency fo is lowered in reverse proportion to the variation of the incidence angles that increases in the order of 16.7, 23.4 and 36.9 degrees.

FIG. 8 illustrates another example of the conventional filter, which is generally adopted in the electric oven as shown in FIG. 3.

Referring to FIG. 8, a choke structure 162 formed in an inner end of a door 121 is bent into three sections including a choke base 163, a choke inner side portion 164 and a choke top 165 which has a narrow gap with cavity side face. Slots 166 are formed only in the choke top 165 at a predetermined interval. That is, rather than being formed in the entire width L21 of the choke top 165, each of the slots 166 is formed along a first length L22 corresponding to a greater portion of the entire width L21 of the choke top 166 except for a second length L23 extended from a bent of the choke top 165. The length of the slot L22 is obtained by subtracting the second length L23 from the entire width L21 of the choke top 166.

This as a consequence induces electromagnetic wave introduced into the cavity from the magnetron to resonate into specific modes, which in turn determine an incidence angle into the oven door. Since a simple $n\lambda/4$ (n=1,3,5, . . . ) choke structure can rarely shield electromagnetic waves having various incidence angles, a plurality of slots 156 and 166 are provided at a predetermined interval. The interval of the slots 156 and 166 is designed to effectively shield electromagnetic waves of any incidence angles.

Incidence angle dependency is regarded as one of important factors for determining the performance of the filter. Since electromagnetic waves generated inside the cavity are distributed into a very complicate mode, they are directed toward the door at various angles ranging from 0 to 90 degrees. Therefore, an excellent filter is required to properly shield the electromagnetic waves directed to the door regardless the incidence angles of the electromagnetic waves. That is, the excellent filter is required not to have incidence angle dependency. However, there is a problem in that existing filters basically have incidence angle dependency. Simulation results of the existing filters are illustrated in FIGS. 7 and 9.

FIG. 7 is a graph illustrating shielding properties of the filter shown in FIG. 6 and FIG. 9 is a graph illustrating shielding properties of the filter shown in FIG. 8.

Referring to FIG. 9, when a radio frequency is incident into the choke structure at three different incident angles I11 (15.6°), I12 (21.7°) and I13 (35.6°) as shown in FIG. 8, the choke structure shows a shielding property that the optimum shielding frequency increases as the incidence angle increases. That is, it is known that when the incidence angle I11 is 15.6°, the optimum shielding frequency is fo, and when the incidence angle I13 is 35.6°, the optimum shielding frequency is fo'.

since the microwave oven or electric oven is operated in a single frequency, and in the conventional filters, the optimum shielding frequency is changed from fo to fo' with respect to some of total incidence angles ranging from 0 to 90 degrees as can be seen in Figs. these filters have limited shielding properties for electromagnetic waves of various incidence angles. Because the shielding ability of a filter is evaluated from its worst shielding level, this necessarily limits the shielding ability of the conventional filters.

SUMMARY OF THE INVENTION

Accordingly, the present invention is directed to an apparatus for shielding electromagnetic wave of an oven door that substantially obviates one or more problems due to limitations and disadvantages of the related art.

An object of the present invention is to provide an apparatus for shielding electromagnetic wave of an oven door which includes a choke means having slots formed therein, more particularly, to a predetermined depth intermediate between the depth of a first filter type, in which the optimum shielding frequency increases in proportion to incidence angles into the choke means, and that of a second filter type, in which the optimum shielding frequency decreases in reverse proportion to incidence angles into the choke means, in order to reduce or completely remove incidence angle dependency.

Another object of the present invention is to provide an apparatus for shielding electromagnetic wave of an oven door which comprises a choke means bent into three sections including a choke base in an inner portion of an oven door or a choke means with minor changes to that just described, a choke inner side portion and a choke top and slots formed in the choke top and the choke inner side portion.

A further object of the present invention is to provide an apparatus for shielding electromagnetic wave of an oven door, in which the slots are formed in the choke top and the choke inner side portion to a predetermined depth, wider in the choke inner side portion than in the choke top.

Still another object of the present invention is to provide an apparatus for shielding electromagnetic wave of an oven door which comprises slots capable of utilizing advantages of two filter types in order to reduce or remove incidence angle dependency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an apparatus for shielding electromagnetic wave of an oven door comprising: a choke means including a choke base formed with an inner portion of the oven door, a choke inner side portion bent perpendicularly from the choke base and a choke top bent from the choke inner side portion to form a front circumferential portion of an oven cavity; and a plurality of slots formed in the choke top and the choke inner side portion at a predetermined interval, each of the slots being extended from a distal end of the choke top to a predetermined point of the choke inner side portion, the predetermined point being distanced the same as or smaller than the half of the width of the choke inner side portion from a joint between the choke top and the choke inner side portion, whereby electromagnetic waves having various modes of incidence angles are shielded from leaking out of the cavity.

According to another aspect of the invention for realizing the object, there is provided an apparatus for shielding electromagnetic wave of an oven door comprising: a structure bent into an L configuration from an inner end of the oven door, which contacts a front plate of an oven cavity, in order to shield the leakage of electromagnetic wave out of the cavity at a bent position, wherein the structure comprising: a choke structure including a first choke portion formed in a door end and a second choke portion perpendicularly bent from the first choke portion; and a filter including a plurality of slots formed in the first and second choke portions at a predetermined interval, each of the slots being extended from the first choke portion to a top portion of the second choke portion corresponding to the same as or smaller than the half of the width of the second choke portion.

According to still another aspect of the invention for realizing the object, there is provided an apparatus for shielding electromagnetic wave provided in an inner end of an oven door, which contacts a front plate of an oven cavity, the apparatus comprising: a choke means including a first choke portion formed in a door end contacting the front plate of the cavity and a first choke portion bent perpendicularly from the first choke portion; and a filter including first and second slots formed in the first and second choke portions at a predetermined interval, each of the first slots being formed in the first choke portion, each of the second slots being formed in the second choke portion and extended from the first slots to a top portion of the second choke portion to a predetermined length, and the each first slot having a width different from that of the each second slot, wherein the each second slot has a length the same as or smaller than the half of the width of the second choke portion, whereby electromagnetic wave is shielded from leaking out of the cavity.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings.

First Embodiment

Figure 10:
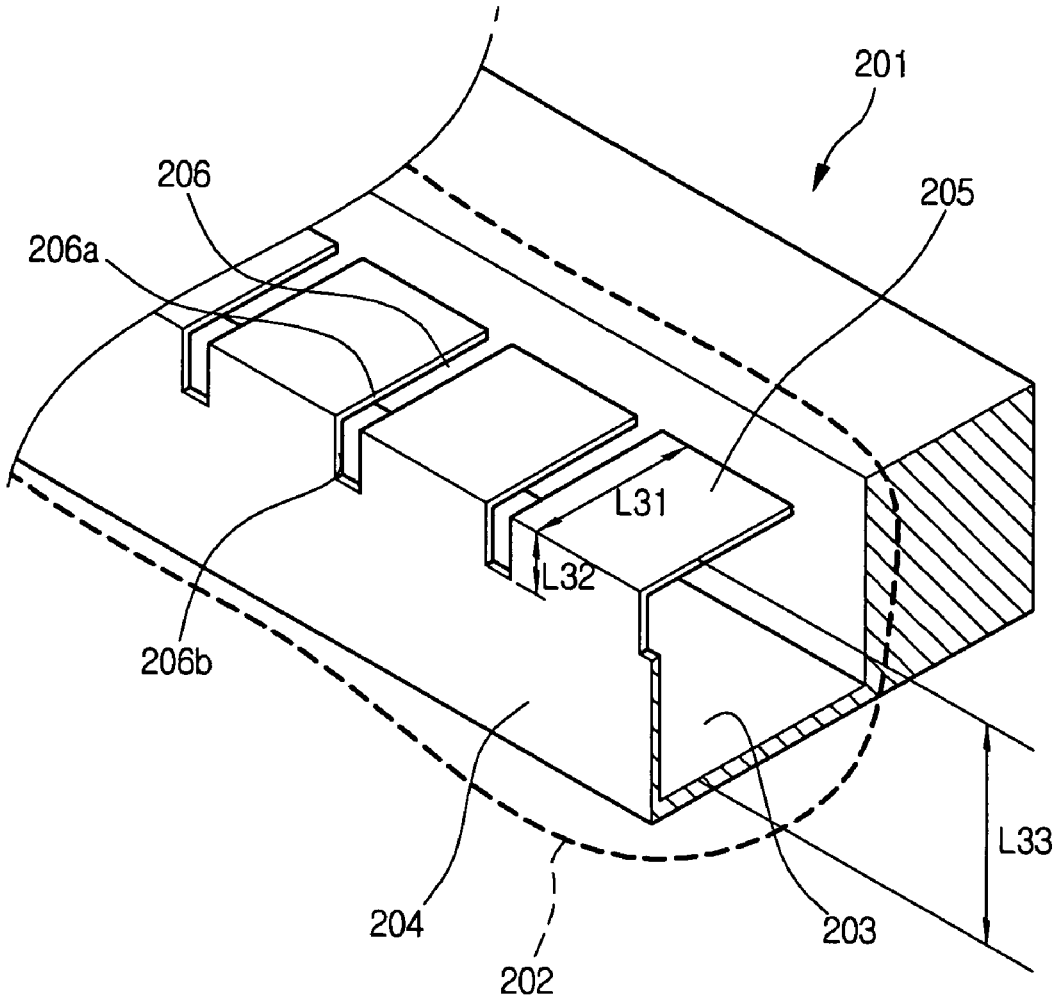
FIG. 10 illustrates a filter as an apparatus for shielding electromagnetic wave of an oven door according to a first embodiment of the present invention.

FIG. 10 illustrates a first embodiment of the present invention.

As shown in FIG. 10, a choke structure 202 is formed at an inner end of a door or door frame 201 to contact a front plate that is formed around a front portion of a cavity. The choke structure 202 is bent into ⊏-shaped sections including a choke base 203, a choke inner side portion 204 and a choke top 205.

The choke base 203 is formed integrally with the door frame, and the door inner portion 204 is bent perpendicularly from the choke base 203 toward the cavity. The choke top 205 is bent from the choke inner side portion 204 toward the inner end of the door frame 201, opposed to the front plate of the cavity. Herein, the depth of the groove of the choke structure 202 corresponds to nearly $n\lambda/4$ (n=1,3,5, . . . ).

The choke structure 202 has a plurality of slots 206 formed in the choke top 205 and the choke inner side portion 204 at a predetermined interval in order to shield the leakage of electromagnetic wave out of the cavity.

For this purpose, each of the slots 206 is incised into a '¬'-shaped groove along a first length L31 corresponding to the entire width of the choke top 205 and a second length L32 corresponding to a top portion of the choke inner side portion 204.

Each slot 206 is divided into a longer slot 206*a* formed in the choke top 205 and a shorter slot 206*b* formed in the choke inner side portion 204. The length L31 of the longer slot 206*a* corresponds to the entire width of the choke top 205, and the length L32 of the shorter slot 206*b* is greater than 0 and less than half of the length L33 of the choke inner side portion, i.e.

$$0 < L32 \leq \frac{L33}{2}.$$

Figure 1:
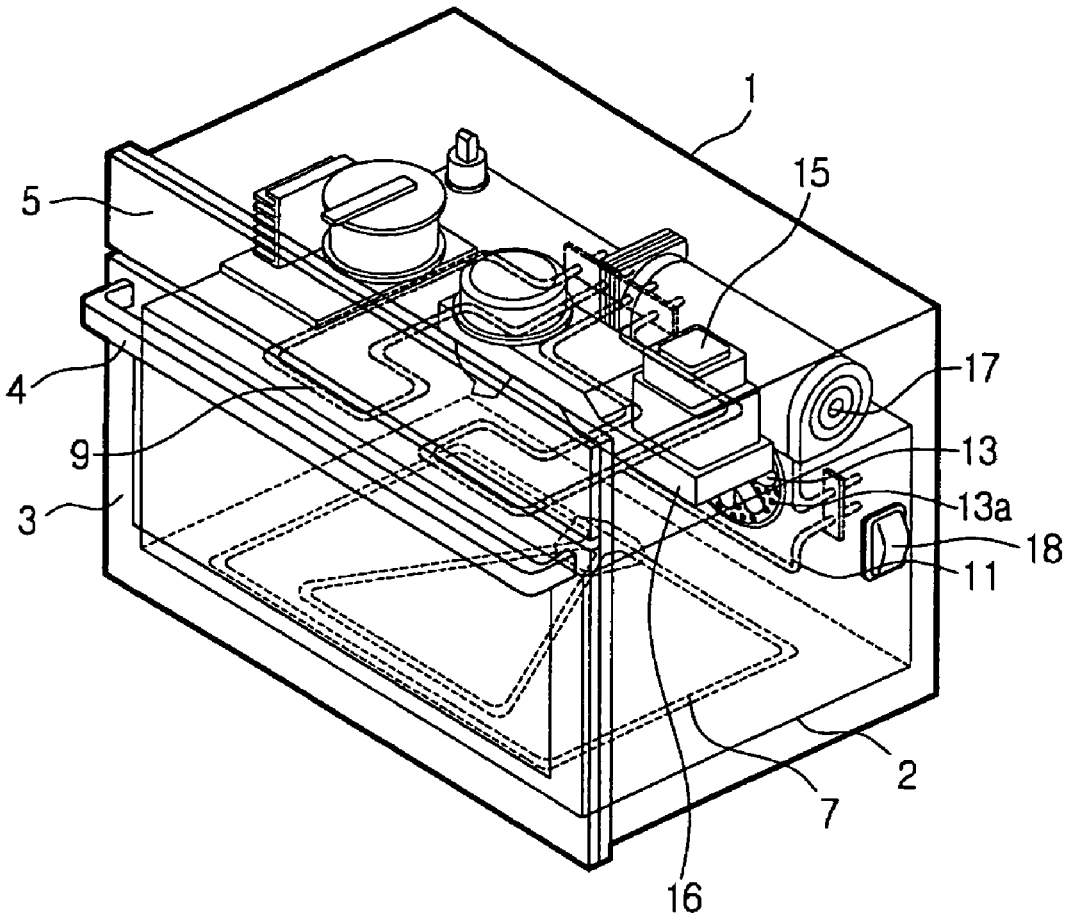
Fig.1 Related Art
FIG. 1 is a schematic perspective view illustrating a conventional electric oven.
Figure 2:
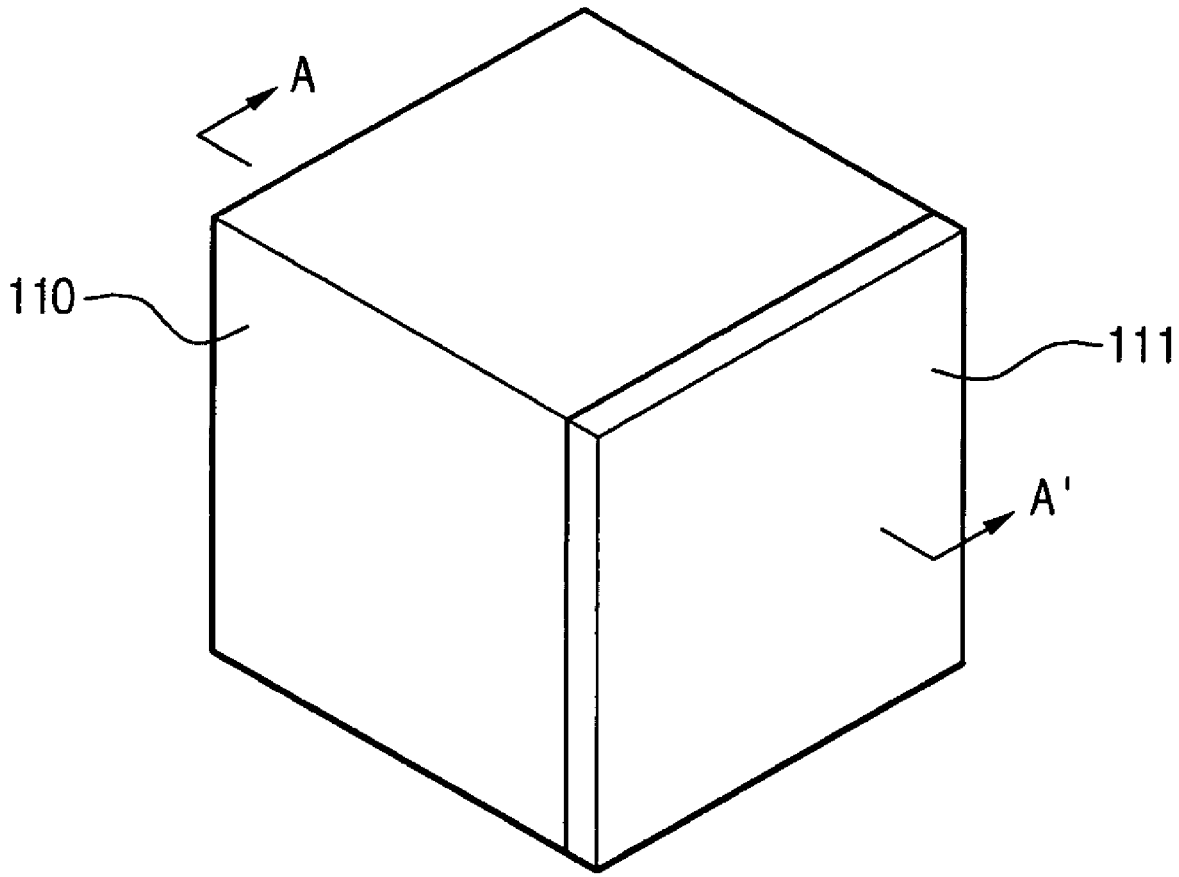
Fig.2 Related Art
FIG. 2 is a schematic perspective view illustrating an electric heating appliance for cooking.
Figure 3:
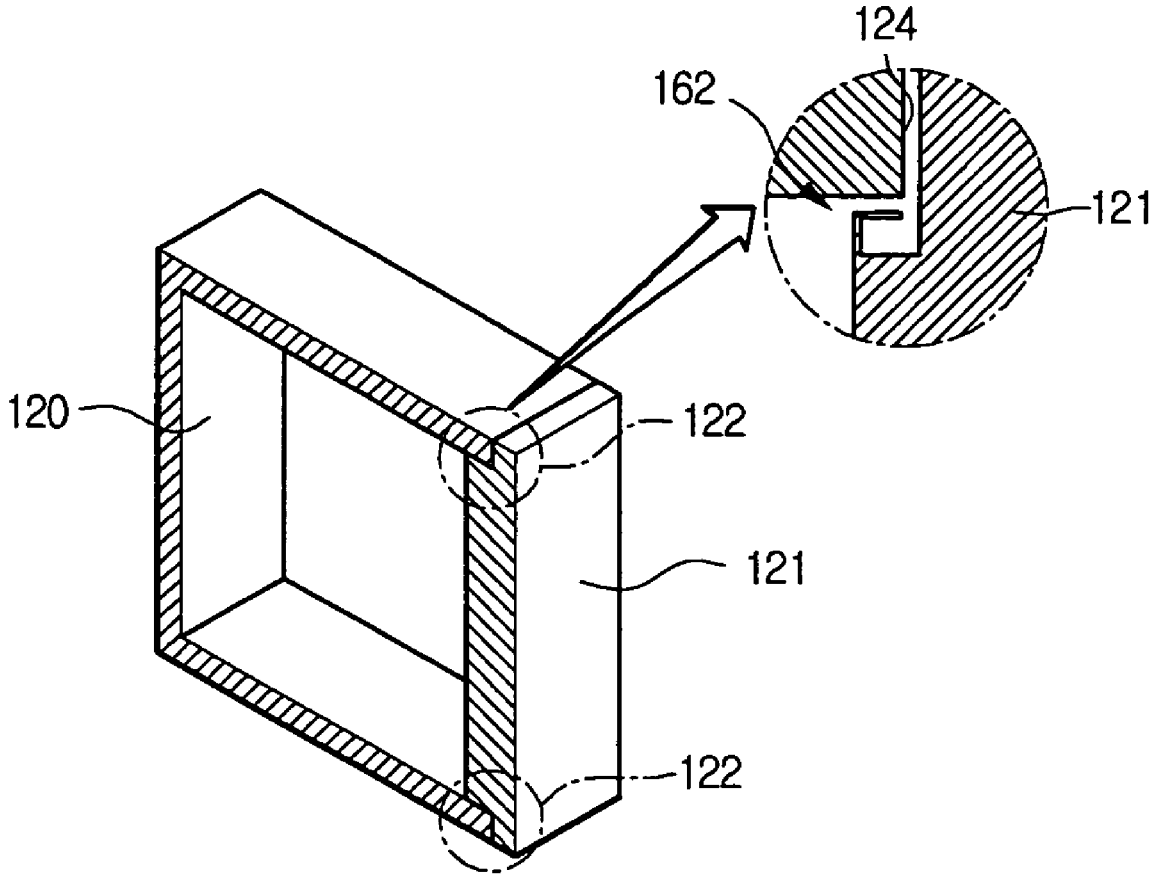
Fig.3 Related Art
FIG. 3 illustrates a contact region between a cavity and a door in an electric oven.
Figure 4:
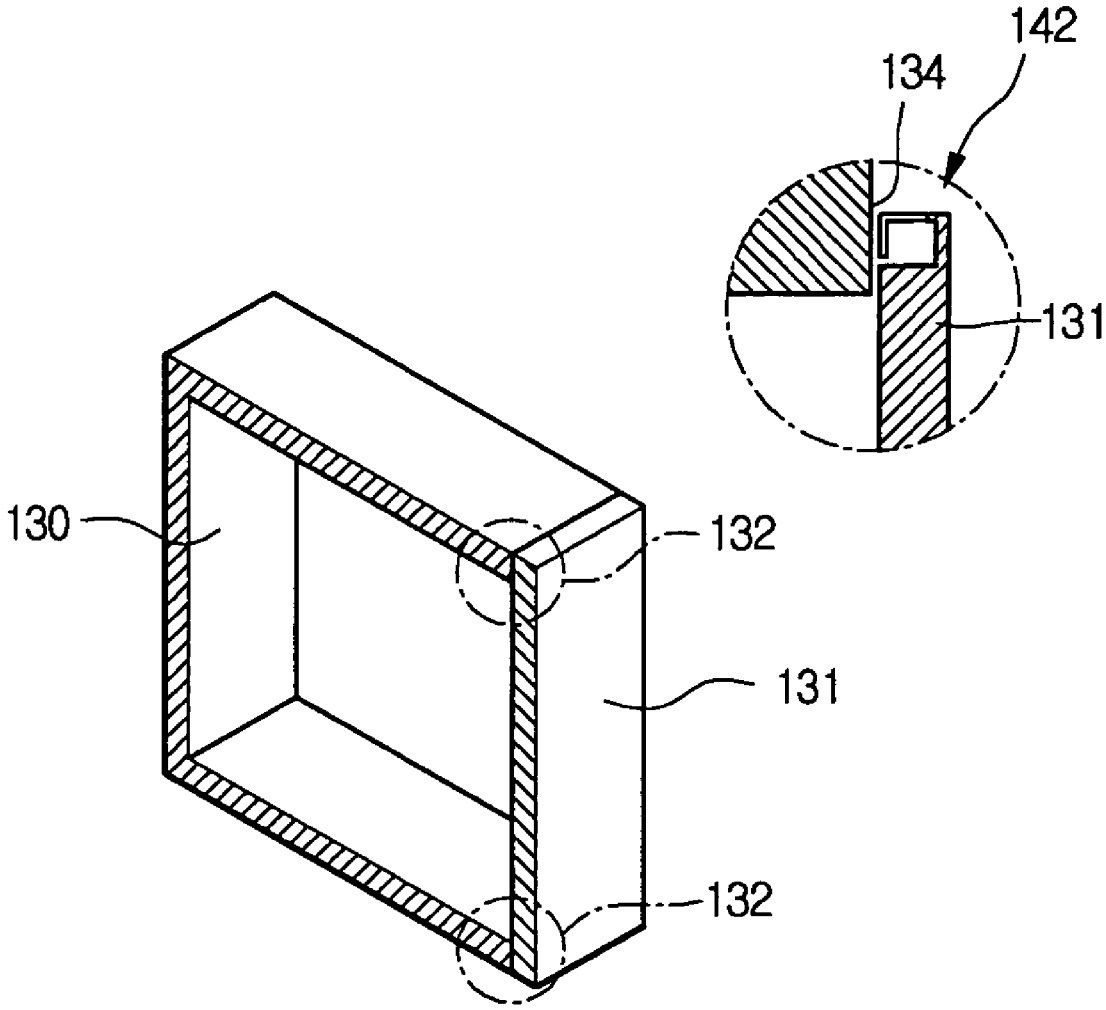
Fig.4 Related Art
FIG. 4 illustrates a contact region between a cavity and a door in an electric oven.
Figure 5:
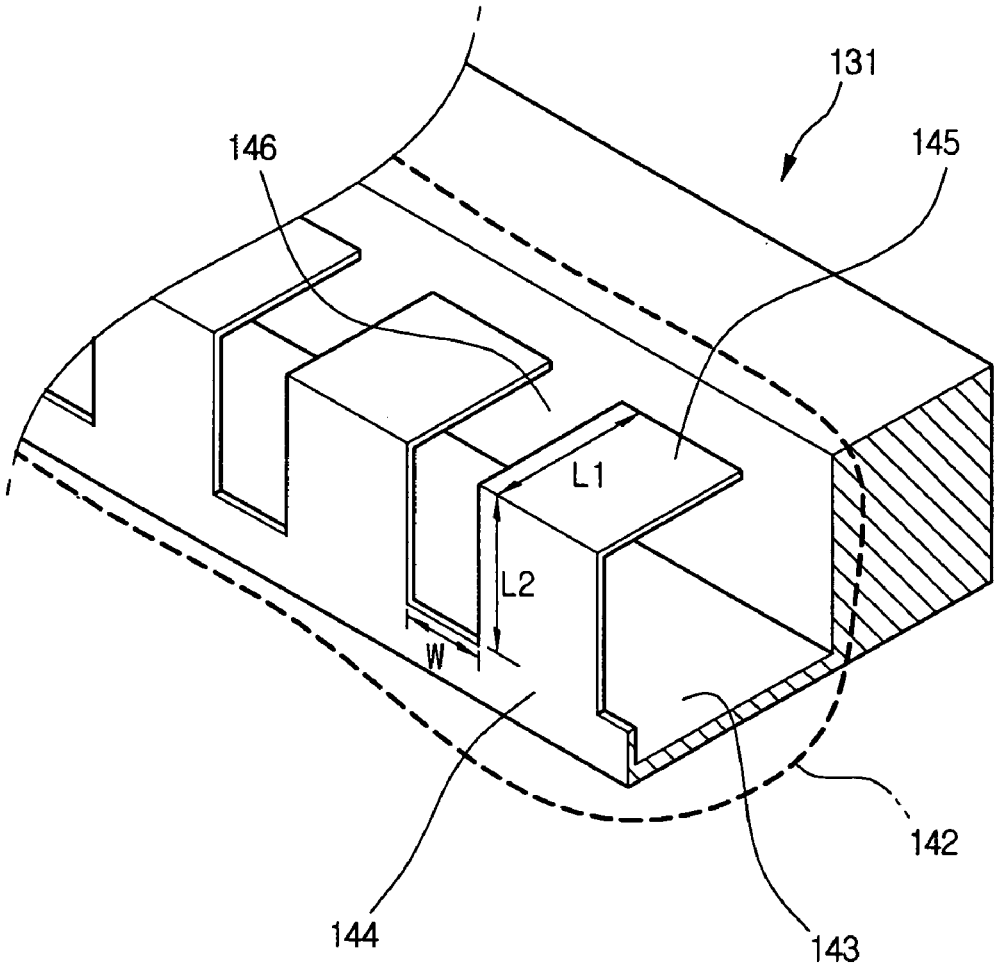
Fig.5 Related Art
FIGS. 5 and 6 illustrate filters provided in a door end of a conventional electric oven, respectively.
Figure 8:
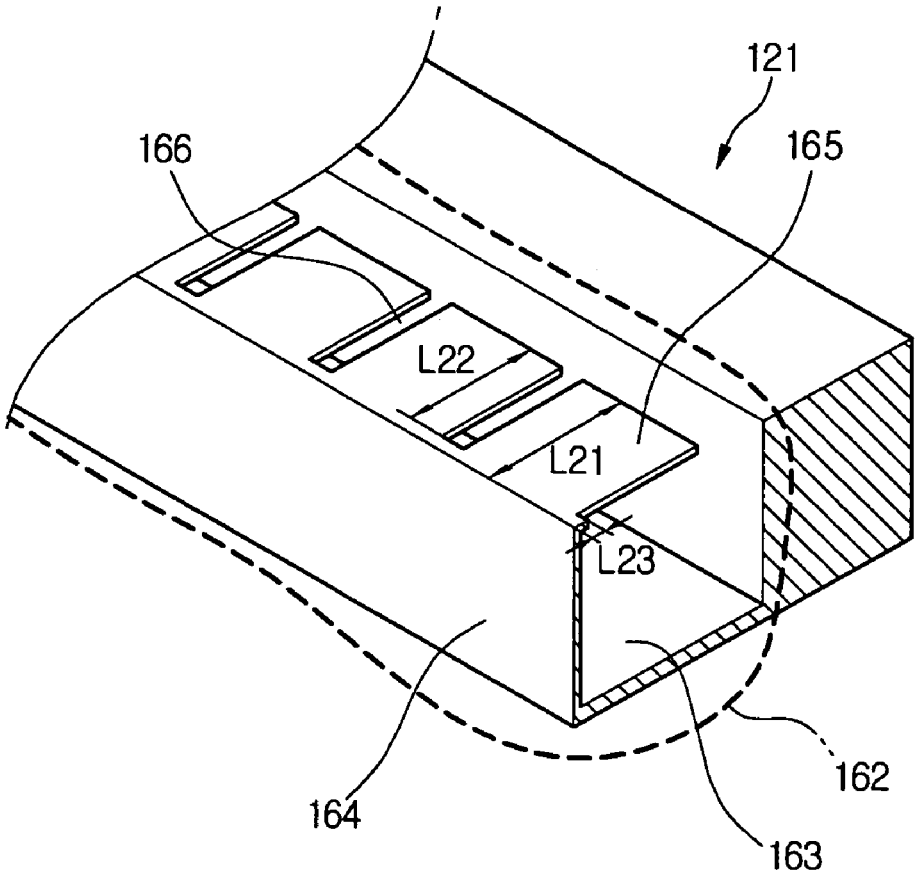
Fig.8 Related Art
FIG. 8 illustrates another example of a conventional filter provided in a door end of a conventional electric oven.
Figure 9:
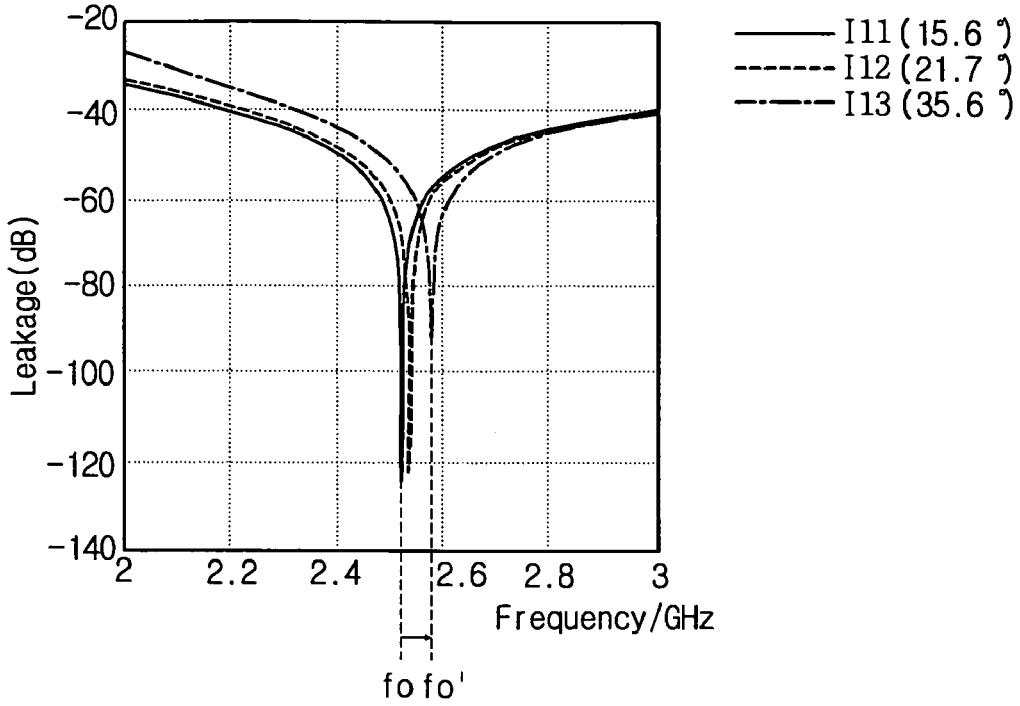
Fig.9 Related Art
FIG. 9 is a graph illustrating shielding properties of the filter shown in FIG. 8.

The slot 206 of this embodiment is configured to be shorter than the slot 146 of the choke structure shown in FIG. 5 but longer than the slot 166 of the choke structure shown in FIG. 8. This slot 206 can be applied to both of the doors of heating appliances for cooking as shown in FIGS. 3 and 4, as a structure capable of utilizing advantages of the two conventional filter structures.

Figure 6:
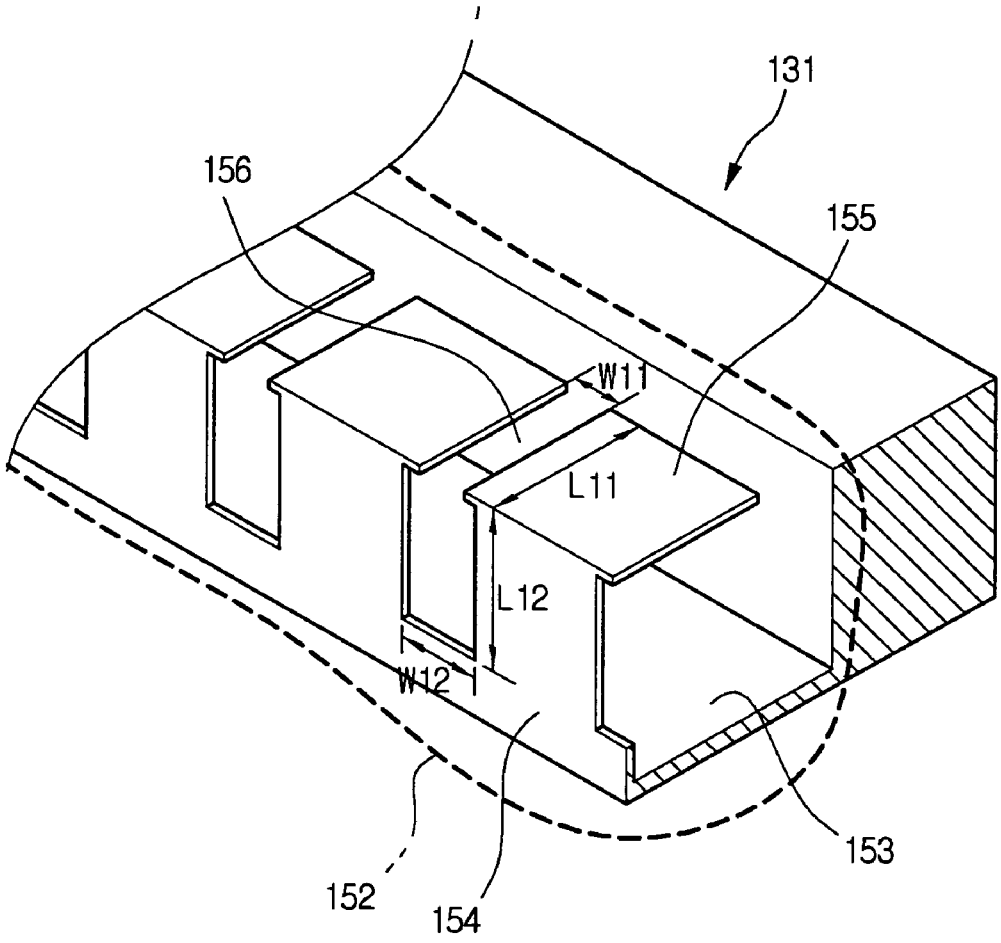
Fig.6 Related Art
Figure 7:
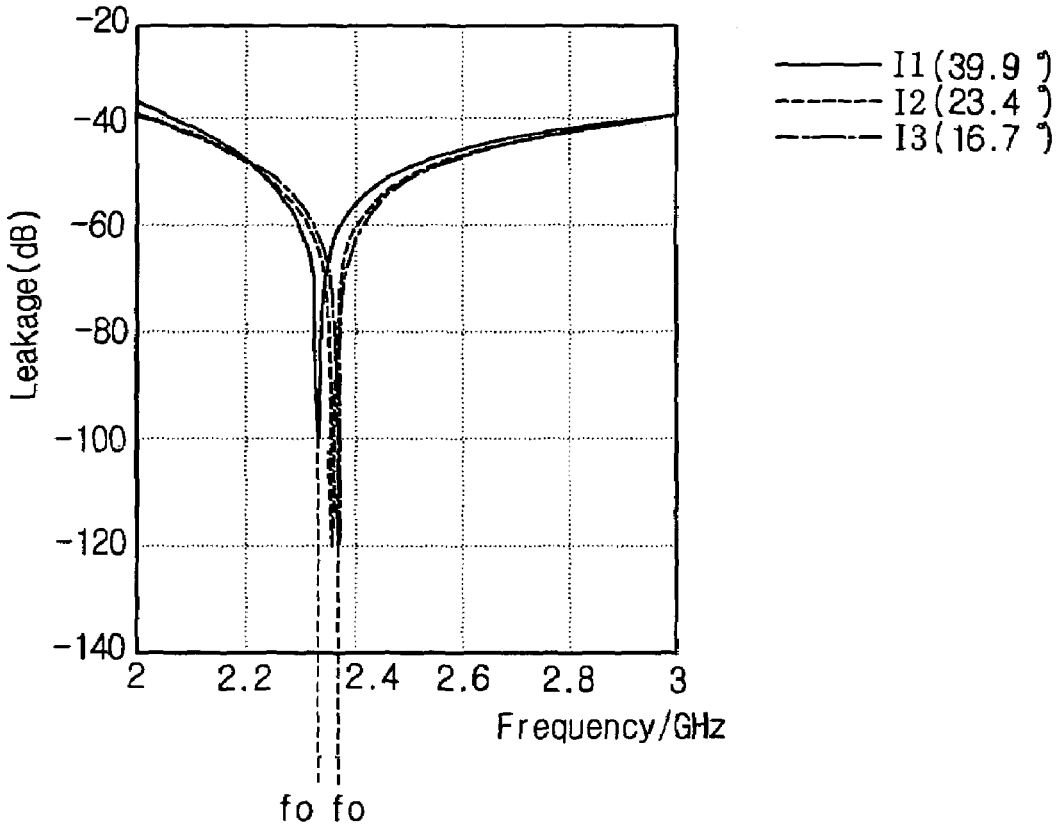
Fig.7 Related Art
FIG. 7 is a graph illustrating shielding properties of the filters shown in FIGS. 5 and 6.

That is, the slots 206 of the present invention are formed to a predetermined depth (or length) that is intermediate between a first length for obtaining the electromagnetic wave shielding property, in which the optimum shielding frequency fo decreases in inverse proportion to the incidence angle in the filters as shown in FIGS. 5 and 6, and a second length for obtaining the electromagnetic wave shielding property, in which the optimum shielding frequency fo increases in proportion to the incidence angle in the filter as shown in FIG. 8. As a result, these slots 206 can reduce or completely remove the incidence angle dependency.

In the first embodiment, the shielding property is varied according to the length of the shorter slots 206*b* formed in the choke inner side portion 204, in which it is necessary for the shorter slots 206*b* not to exceed ½ of the length L33 of the choke inner side portion 204.

The slots 206 have a nearly uniform width W along both of the longer slots 206*a* and the shorter slots 206*b*.

Second Embodiment

Figure 11:
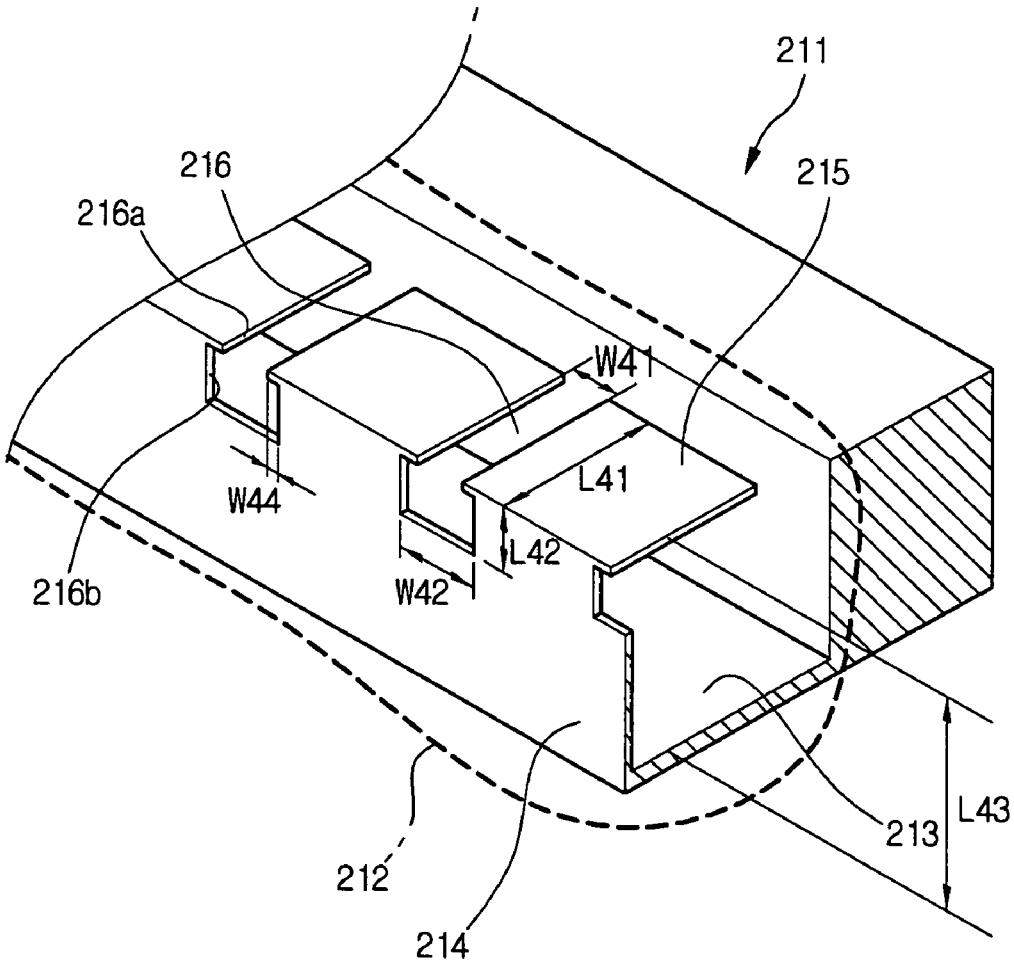
FIG. 11 illustrates a filter as an apparatus for shielding electromagnetic wave of an oven door according to a second embodiment of the present invention.

FIG. 11 illustrates a second embodiment of the present invention.

Referring to FIG. 11, a choke structure 212 is formed in an inner end of a door or door frame 211 to contact a front plate that is formed around a front portion of a cavity. The choke structure 212 is bent into '⊏'-shaped sections including a choke base 213, a choke inner side portion 214 and a choke top 215.

The choke base 213 is formed integrally with the door frame 211, and the choke inner side portion 214 is bent perpendicularly from the choke base 213 toward the cavity. The choke top 215 is bent from the choke inner side portion 214 toward the inner end of the door frame 211, opposed to the front plate of the cavity.

The choke structure 202 has slots 216 formed in the choke top 215 and the choke inner side portion 214 at a predetermined interval in order to shield the leakage electromagnetic wave out of the cavity through the oven door.

For this purpose, each of the slots 216 is incised into an L configuration along a first length L41 corresponding to the entire width of the choke top 215 and a second length L42 corresponding to a top portion of the choke inner side portion 214. The each slot 216 has a first width W41 of the first length L41 and a second width W42 of the second length larger than the first width W41.

The each slot 216 is divided into a longer slot 216*a* formed in the choke top 215 and a shorter slot 216*b* formed in the choke inner side portion 214. The length L41 of the longer slot 216*a* corresponds to the entire with of the choke top 215, and the length L42 of the shorter slot 216*b* corresponds to the top portion of the choke inner side portion 214. The width W41 of the longer slot 206*a* is smaller than the width W42 of the shorter slot 206*b*.

Herein, the length L42 of the shorter slot 216*b* is configured not to exceed ½ of the width L43 of the choke inner side portion 214. The width 216*b* of the shorter slot 216*b* is formed larger than that of the longer slot 216*a*.

The longer and shorter slots of the choke structures of the present invention function as a short-circuit transmission line of a propagation path, and in cooperation of the longer and shorter slots, shield electromagnetic waves of various incidence angles directed toward the choke structures.

Figure 12:
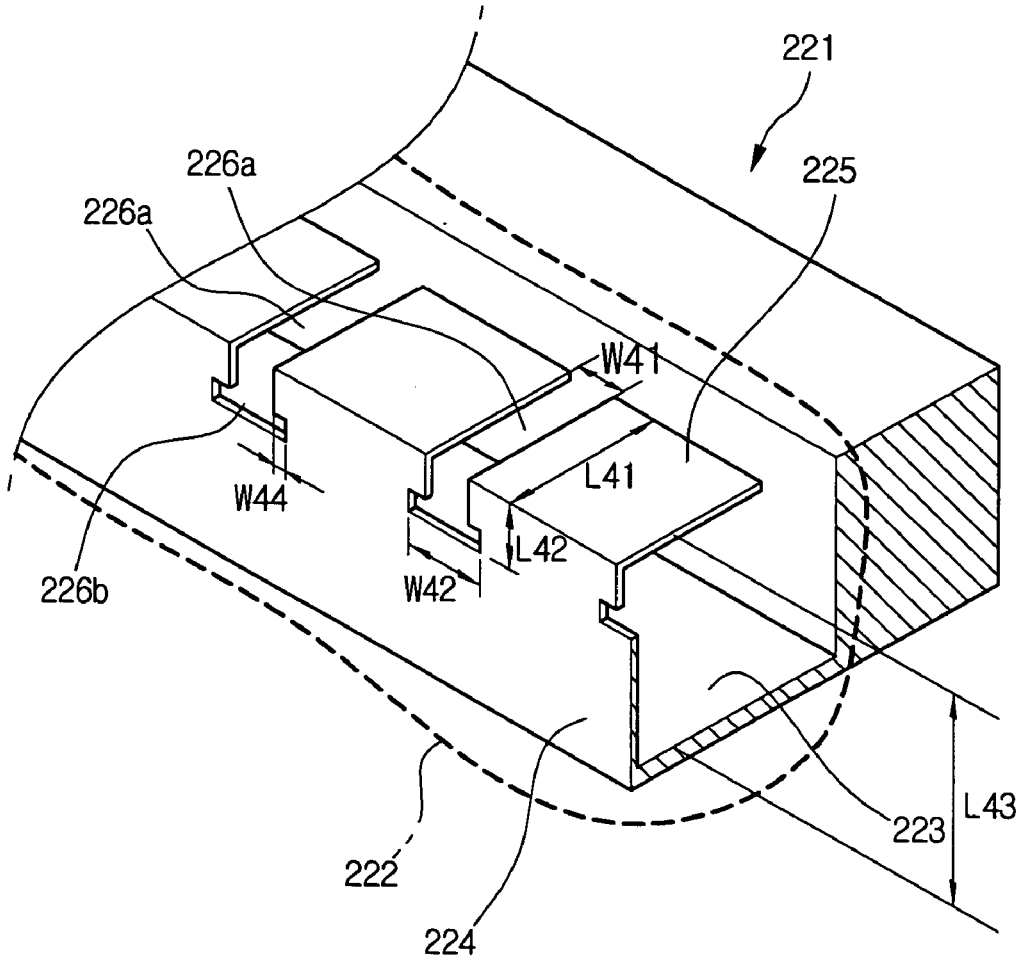
FIGS. 12 and 13 illustrates a filter having a different slot width and serving as an apparatus for shielding electromagnetic wave of an oven door according to another embodiment of the present invention.
Figure 13:
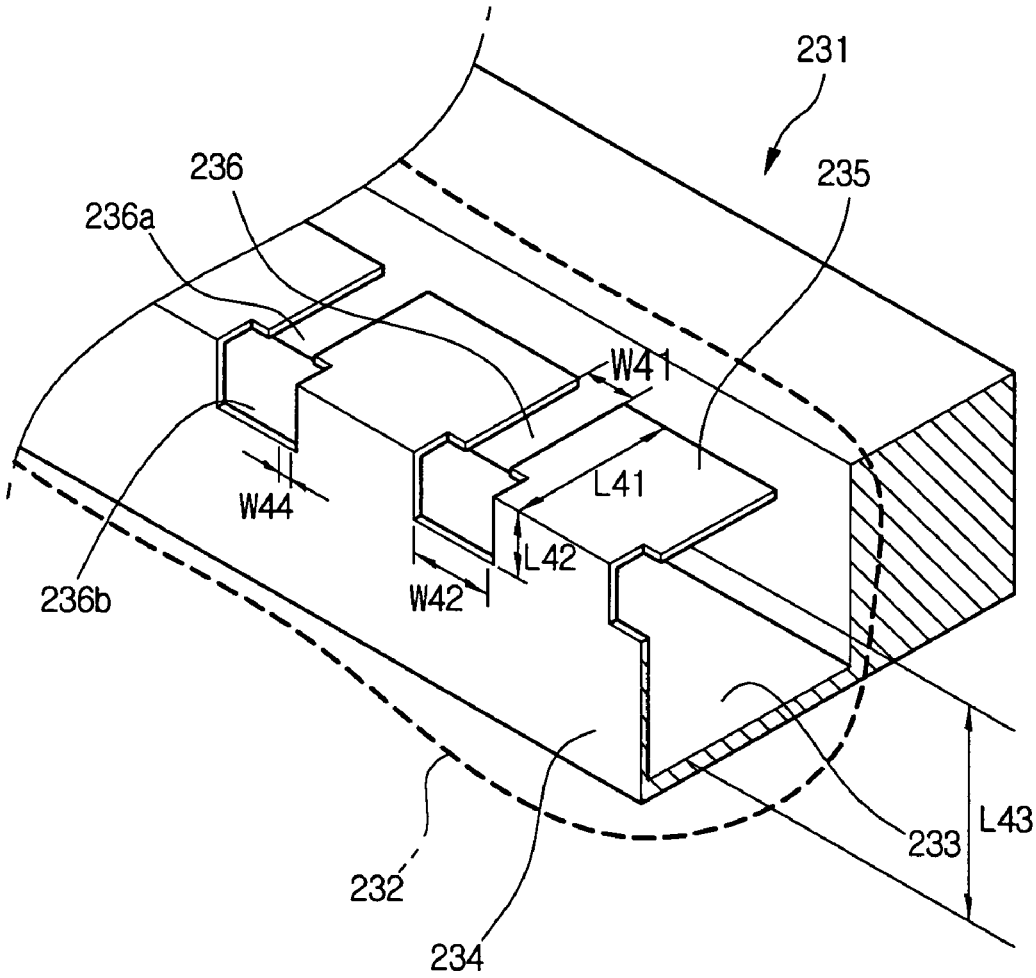

In another embodiment of the present invention, a choke structure 221 or 231 shown in FIG. 12 or FIG. 13 is configured such that slots 226 and 236 have different widths.

Referring to FIG. 12, the choke structure 221 is configured such that a shorter slot 226*b* includes a first portion which is directly connected with a longer slot 226*a* and has the same width as that of the longer slot 226*a*, and a second portion extending to the first portion of the shorter slot 226*b* and having a width W42 which is larger than that of the first portion of the short slot 226*b*.

Referring to FIG. 13, the choke structure 231 is configured such that a longer slot 236*a* includes a first portion having a first width W41 and a second portion having a second width W42 which is larger than the first width W41 and is the same as that of a shorter slot 236*b*.

Comparing the choke structure 221 of FIG. 12 with the choke structure 231 of FIG. 13, the two structures are similar in that the length of each of the shorter slots 222*b* and 232*b* is formed below half of a length of a choke inner side portion 224 or 234, but are different in that the start point of the portions having an increased width are changed.

Figure 14:
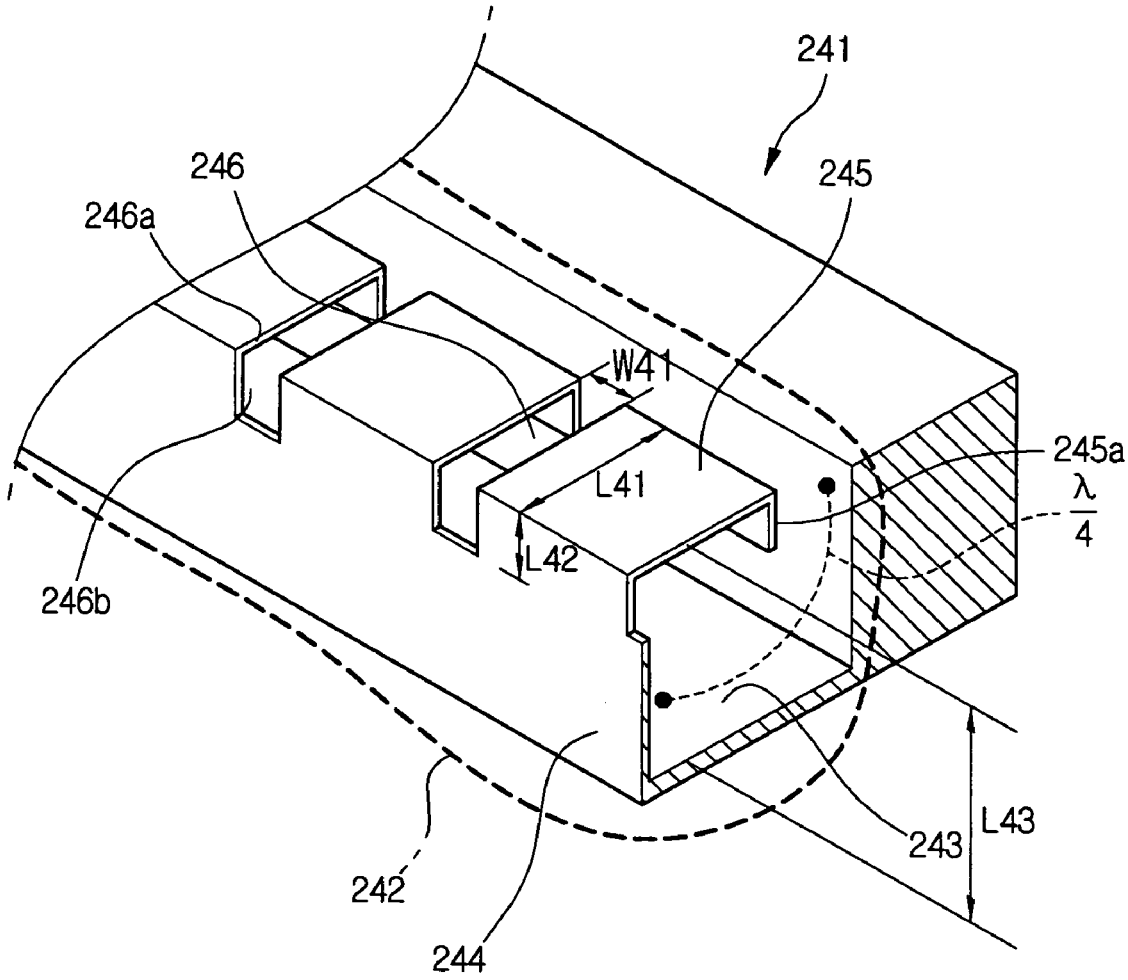
FIG. 14 illustrates in detail a choke structure as an apparatus for shielding electromagnetic wave of an oven door according to a second embodiment of the present invention.

In another embodiment of the present invention, a choke structure 241 shown in FIG. 14 is configured to have a groove depth corresponding to λ/4. Referring to FIG. 14, the choke structure 241 is first bent at a first connection edge between a choke inner side portion 244 and a choke upper portion 245 and is secondly bent at a second connection edge between the choke upper portion 245 and a choke outer side portion 245*a* opposed to the choke inner side portion 244. At this time, a slot 246 may be formed to have a uniform width or different widths along its length direction. Alternatively, the slot portion formed in the choke outer side portion 245*a* is formed to have a length which is the same as or longer than a length of the slot portion formed in the choke inner side portion 244.

The choke structure is at least twice bent from the choke inner side portion or the choke top side portion, wherein the choke structure has a double layer.

Figure 15:
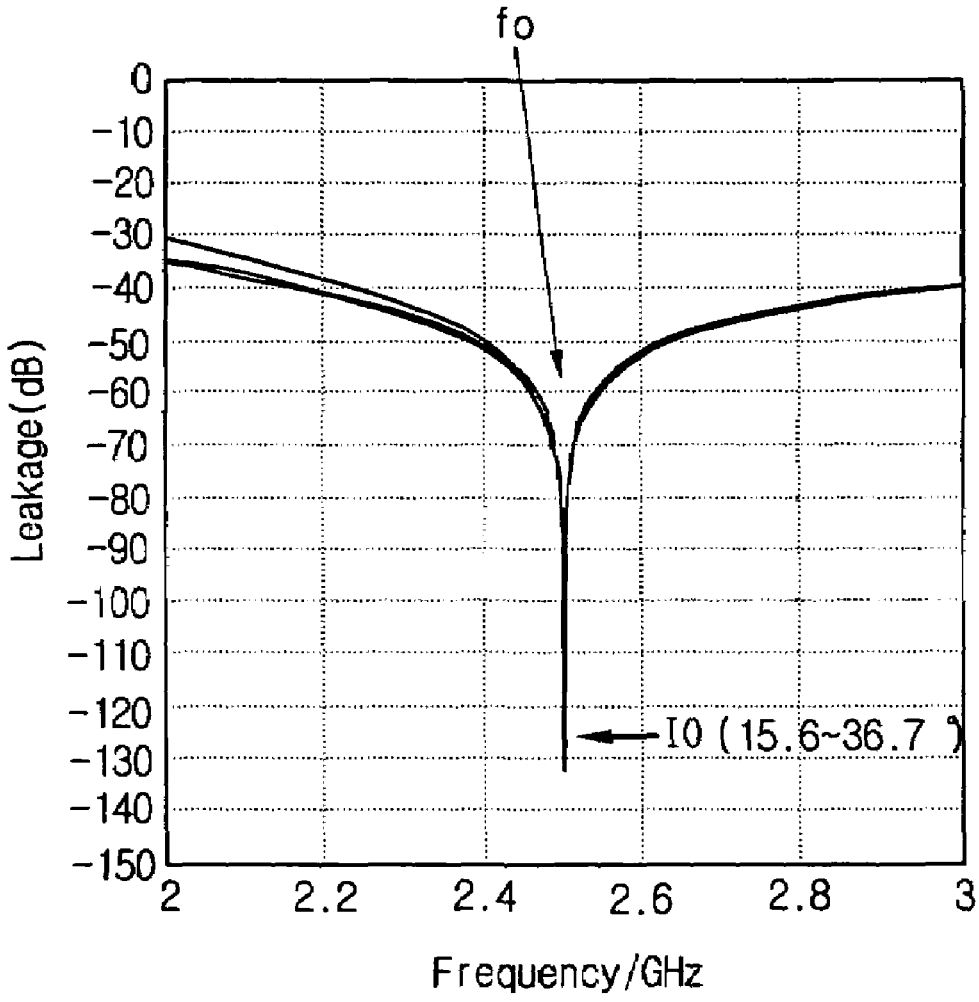
FIG. 15 is a graph illustrating electromagnetic wave-shielding properties of the filters according to the present invention.

The oven door filters according to the embodiments of the present invention have shielding properties as shown in FIG. 15.

FIG. 15 is a graph illustrating shielding properties of the filters of the present invention. The graph shows that an optimum shielding frequency is not varied through various incidence angles and thus there is no dependency on the incidence angle.

When a simulation was made to observe the shielding properties of the filters of the invention, an optimum shielding frequency fo was maintained constant even though incidence angles were changed from 11.5 to 36.7 degrees. This causes improvement to the shielding ability of the inventive filters (90 dB) for nearly 1,000 times over that of the conventional filters (60 dB) as shown in FIG. 8. With this improvement in electromagnetic wave-shielding ability, the filters of the present invention can properly cope with Electro-Magnetic Interference (EMI) problems.

Accordingly, the present invention provides the filter, which has longer slots formed in the choke top and the shorter slots formed in the choke inner side portion, inside a door of a microwave oven or an electric oven.

According to the apparatus for shielding electromagnetic wave of the oven door of the present invention, the slots formed in the choke inner side portion and the choke top at a predetermined interval provide a structure capable of utilizing advantages of two types of conventional filters in order to reduce or remove the incidence angle dependency of shielding properties.

As another advantageous effect, the apparatus of the present invention has a shielding ability of at least thousand times superior to that of the prior art thereby to improve EMI-related performance of electronic appliances.

Further another advantageous effect is that the filter of the present invention has excellent electromagnetic wave-shielding properties and therefore can be applied to all types of heating appliances for cooking.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An apparatus for shielding electromagnetic wave of an oven door comprising:

a choke means including a choke base formed with an inner portion of the oven door, a choke inner side portion bent perpendicularly from the choke base and a choke top bent from the choke inner side portion to form a front circumferential portion of an oven cavity; and a plurality of slots formed in the choke top and the choke inner side portion at a predetermined interval, each of the slots being extended from a distal end of the choke top to a predetermined point of the choke inner side portion, the predetermined point being distanced the same as or smaller than the half of the width of the choke inner side portion from a joint between the choke top and the choke inner side portion, whereby electromagnetic waves having various modes of incidence angles are shielded from leaking out of the cavity.

2. The apparatus according to claim 1, wherein each of the slots includes a top slot formed in the entire width of the choke top and a side slot extended from the top slot into the choke inner side portion.

3. The apparatus according to claim 1, wherein the top slot comprises a first slot width which is equal to the width of the side slot, and a second slot width which is equal to or smaller than the first slot width.

4. The apparatus according to claim 1, wherein the side slot comprises a first slot width which is equal to the width of the top slot, and a second slot width which is equal to or larger than the first slot width.

5. An apparatus for shielding electromagnetic wave of an oven door comprising:

a structure bent into an L configuration from an inner-end of the oven door, which contacts a front plate of an oven cavity, in order to shield the leakage of electromagnetic wave out of the cavity at a bent position, wherein the structure comprising:

a choke means including a first choke portion formed in a door end and a second choke portion perpendicularly bent from the first choke portion; and a filter including a plurality of slots formed in the first and second choke portions at a predetermined interval, each of the slots being extended from the first choke portion to a top portion of the second choke portion corresponding to the same as or smaller than the half of the width of the second choke portion.

6. The apparatus according to claim 5, wherein each of the slots has an equal width through the first and second choke portions.

* * * * *